US005475997A

United States Patent [19]

Chung

[11] Patent Number: 5,475,997

[45] Date of Patent: Dec. 19, 1995

[54] LOCK ASSEMBLY

[76] Inventor: Chia-Lieh Chung, No. 80, Lane 161, Hua-Cheng Rd., Hsin-Chuang City, Taipei Hsien, Taiwan

[21] Appl. No.: 273,876

[22] Filed: Jul. 12, 1994

[51] Int. Cl.[6] ..... E05B 9/04

[52] U.S. Cl. ..... 70/375; 70/358; 70/419; 70/395; 70/397

[58] Field of Search ..... 70/356, 357, 358, 70/367–369, 372, 375, 379 R, 379 A, 381, 382, 385, 389, 395–401, 405, 406, 409, 419–421, 490–493, DIG. 35, DIG. 60

[56] References Cited

U.S. PATENT DOCUMENTS

| | | | |
|---|---|---|---|
| 1,382,826 | 6/1921 | Dove | 70/395 X |
| 1,892,419 | 12/1932 | Best | 70/375 |
| 2,022,070 | 11/1935 | Williams et al. | 70/493 X |
| 3,729,964 | 5/1973 | Hsu | 70/389 X |
| 3,808,853 | 5/1974 | Helenurm | 70/398 X |
| 3,863,476 | 2/1975 | Patriquin | 70/419 |
| 4,196,604 | 4/1980 | Vorob | 70/419 X |
| 4,472,953 | 9/1984 | Gater | 70/375 X |
| 5,131,247 | 7/1992 | Hsu | 70/375 X |
| 5,148,690 | 9/1992 | Wang | 70/375 X |
| 5,355,702 | 10/1994 | Escribens | 70/397 X |

FOREIGN PATENT DOCUMENTS

| | | | |
|---|---|---|---|
| 969940 | 12/1950 | France | 70/358 |
| 1104121 | 11/1955 | France | 70/358 |
| 1176516 | 8/1964 | Germany | 70/358 |
| 667305 | 9/1988 | Switzerland | 70/358 |

*Primary Examiner*—Peter M. Cuomo
*Assistant Examiner*—Suzanne L. Dino
*Attorney, Agent, or Firm*—Finnegan, Henderson, Farabow, Garrett & Dunner

[57] ABSTRACT

A lock assembly includes a lock shell, at least first and second key plugs, at least first and second tumbler means, and a key for operating the first and second tumbler means. The lock shell has a front end, a rear end, and an accommodation hole extending from the front end to the rear end. The first and second key plugs are aligned axially and are mounted rotatably within the accommodation hole of the lock shell. The first and second key plugs respectively have first and second key ways. The first and second tumbler means are used for positioning respectively the first and second key plugs against the lock shell when the lock assembly is in a locked position. The key can operate the first and second tumbler means so as to rotate the first and second key plugs simultaneously. The first and second key ways are aligned for extension of the key from the first key way to the second key way when the first key plug is turned a predetermined angle relative to the second key plug by operating the first tumbler means. The second key plug is rotatable after the first and second key ways are aligned with each other.

7 Claims, 6 Drawing Sheets

LOCK ASSEMBLY

BACKGROUND OF THE INVENTION

1. Field of the Invention

This invention relates to a lock assembly, more particularly to a lock assembly which has at least two lock sections that can be operated successively by a single key.

2. Description of the Related Art

Generally, a conventional lock assembly has a lock section which can be unlocked by means of a key. The conventional lock assembly 10, as shown in FIG. 1, includes a lock shell 11, a key plug 12, and a tumbler means 13.

The lock shell 11 has a front end, a rear end, an accommodation hole 111 which extends from the front end to the rear end of the lock shell 11, and an annular dent portion 112 which is formed in the front end of the lock shell 11.

The key plug 12 is mounted rotatably within the accommodation hole 111 of the lock shell 11 and has a flange 122 which projects outwardly from a front end of the key plug 12 and which lies in the annular dent portion 112 of the lock shell 11 so as to retain the key plug 12 on the lock shell 11 when the key plug 12 is mounted within the accommodation hole 111. The key plug 12 further has a key way 121 which is accessible from the front end thereof for receiving a key 20. Two retaining protrusions 123 project respectively from upper and lower portions of a rear end of the key plug 12 so as to define a retaining space 125 between the inner surfaces of the retaining protrusions 123 for receiving a tailpiece 14 (see FIG. 2) which is used to unlock the lock assembly 10 in a known manner when the tailpiece 14 is rotated synchronously with the key plug 12. Each of the retaining protrusions 123 has an annular groove 124 formed in the curved outer surface thereof. A C-shaped lock element 15 is sleeved securely on the annular grooves 124 of the retaining protrusions 123 of the key plug 12 in order to lock the key plug 12 on the lock shell 11 (see FIG. 2).

The tumbler means 13 includes five outer tumbler holes 131 which are formed in the lock shell 11 to receive five outer tumbler pins 133 and five tumbler springs 134 therein, five inner tumbler holes 132 which are formed radially in the key plug 12 to communicate with the key way 121 and which are aligned respectively with the outer tumbler holes 131 when the lock assembly 10 is at a locked position, and five inner tumbler pins 135 which are received respectively within the inner tumbler holes 132 and which are in contact with the outer tumbler pins 133. Accordingly, the tumbler springs 134 urge the outer and inner tumbler pins 133, 135 toward the key way 121 of the key plug 12 so that the outer tumbler pins 133 are disposed between the junction of the key plug 12 and the lock shell 11. In this way, rotation of the key plug 12 relative to the lock shell 11 is thus prevented by the outer tumbler pins 133, thereby locking the lock assembly 10.

The key 20 includes a handle 21 which is formed integrally with a key body 22. The key body 22 has a plurality of actuating protrusions 23 of different shapes for operating the inner tumbler pins 135 when the key body 22 is inserted into the key way 121 of the key plug 12, thereby disengaging the key plug 12 from lock shell 11 so as to permit rotation of the key plug 12 relative to the lock shell 11 in order to unlock the lock assembly 30, as shown in FIG. 2. However, because the lock assembly 10 has only one key plug 12, a skilled person can easily unlock the conventional lock assembly 10 with the use of a simple tool in a very short time.

SUMMARY OF THE INVENTION

Therefore, the main objective of this invention is to provide a lock assembly which has at least two lock sections that can be operated successively by a single key so as to enhance the pickproof characteristics of the lock assembly.

According to this invention, a lock assembly includes a lock shell, at least first and second key plugs, at least first and second tumbler means, and a key for operating the first and second tumbler means. The lock shell has a front end, a rear end, and an accommodation hole extending from the front end to the rear end. The first and second key plugs are aligned axially and are mounted rotatably within the accommodation hole of the lock shell. The first and second key plugs have first and second key ways respectively. The first and second tumbler means are used for positioning the first and second key plugs respectively against the lock shell when the lock assembly is in a locked position.

The first tumbler means includes first outer tumbler holes formed in the lock shell, first inner tumbler holes formed radially in the first key plug to communicate with the first key way and aligned respectively with the first outer tumbler holes when the lock assembly is in the locked position, and first tumbler pin units received in the first outer and inner tumbler holes and biased toward the first key way when the lock assembly is in the locked position. The second tumbler means includes second outer tumbler holes formed in the lock shell and spaced angularly from the first outer tumbler holes by an angle of 90 degrees, second inner tumbler holes formed radially in the second key plug to communicate with the second key way and aligned respectively with the second outer tumbler holes when the lock assembly is in the locked position, and second tumbler pin units received in the second outer and inner tumbler holes and biased toward the second key way when the lock assembly is in the locked position. The key can operate the first and second tumbler pin units of the first and second tumbler means so as to rotate the first and second key plugs simultaneously. The first and second key ways are aligned for extension of the key from the first key way to the second key way when the first key plug is turned a predetermined angle relative to the second plug after operating the first tumbler pin units of the first tumbler means. The second key plug is rotatable after the first and second key ways are aligned with each other.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 3:
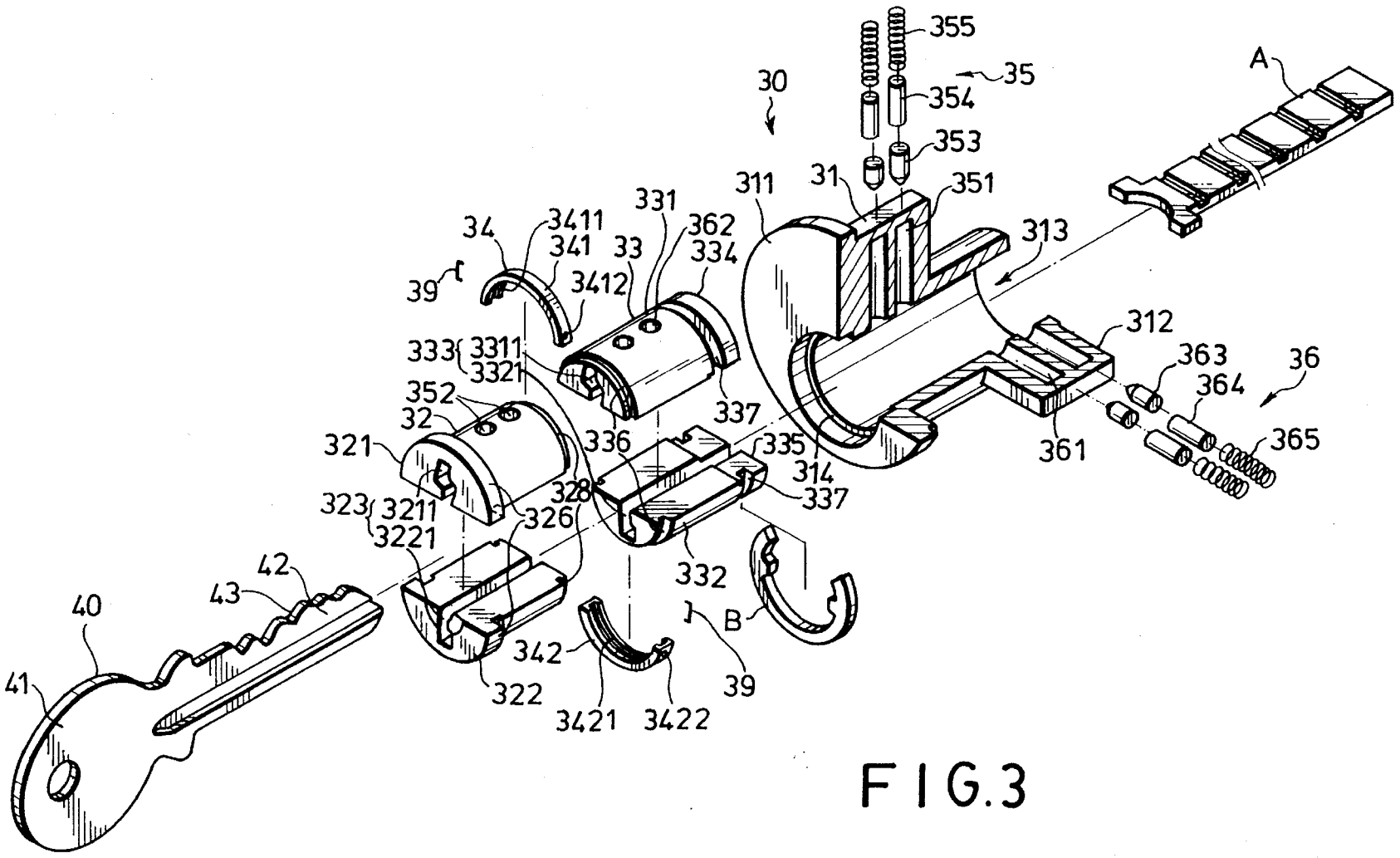
FIG. 3 is a partially sectional exploded view showing a lock assembly of the first preferred embodiment of this invention.

Referring to FIG. 3, a lock assembly 30 of the first preferred embodiment of this invention includes a lock shell 31, firsthand second key plugs 32, 33, a coupling means 34, first and second tumbler means, and a key 40.

The lock shell 31 has a front end 311, a rear end 312, an accommodation hole 313 which extends from the front end 311 to the rear end 312, and an annular dent portion 314 formed in the front end 311 of the lock shell 31.

The first key plug 32 includes first and second plug halves 321, 322. The first and second plug halves 321, 322 are substantially semi-circular in cross-section. Each of the first and second plug halves 321, 322 has a clamping face provided with a respective axially extending notch 3211, 3221 which cooperate to confine a rectangular first key way 323 when the first and second plug halves 321, 322 abut against each other so as to constitute a cylindrical first key plug 32. Accordingly, the cylindrical first key plug 32 can be mounted rotatably within the accommodation hole 313 of the lock shell 31 adjacent to the front end 311 of the lock shell 31. The first key plug 32 further has an annular flange 326 which projects outwardly from a front end thereof and which lies in the annular dent portion 314 of the lock shell 31 in order to retain the first key plug 32 on the lock shell 31. A first annular groove 328 is formed in a rear end of the first key plug 32.

The second key plug 33 includes third and fourth plug halves 331, 332. The third and fourth plug halves 331, 332 are substantially semi-circular in cross-section. Each of the third and fourth plug halves 331, 332 has a clamping face provided with a respective axially extending notch 3311, 3321 which cooperate to confine a rectangular second key way 333 when the third and fourth plug halves 331, 332 abut against each other so as to constitute a cylindrical second key plug 33. Accordingly, the cylindrical second key plug 33 can be mounted rotatably within the accommodation hole 313 of the lock shell 31 adjacent to the rear end 312 of the lock shell 31 and is aligned axially with the first key plug 32. In this way, the front end of the second key plug 33 is adjacent to and is,connected to the rear end of the first key plug 32 by means of the coupling means 34 so as to permit the first key plug 32 to rotate relative to the second key plug 33 when the first key plug 32 is at an unlocked position. When the lock assembly 30 is at a locked position, the cross section of the first key way 323 of the first key plug 32 forms an angle of 90 degrees with the cross section of the second key way 333 of the second key plug 33. The second key plug 33 further has a second annular groove 336 formed in the front end thereof.

The coupling means 34 has a pair of opposite retaining elements 341, 342 of substantially semi-circular shape which are provided around the adjacent rear and front ends of the first and second key plugs 32, 33. The retaining elements 341, 342 respectively have two circumferential flanges 3411, 3421 which extend respectively and radially into the first and second annular grooves 328, 336 (see FIG. 4) and which are slidable therealong. Two connecting elements 39 respectively interconnect adjacent distal ends of the retaining elements 341, 342 in such a manner that each of the connecting elements 39 has two end portions which are respectively inserted into the holes 3412, 3422 of the adjacent distal ends of the retaining elements 341, 342, thereby retaining the retaining elements 341, 342 within the first and second annular grooves 328, 336 of the first and second key plugs 32, 33.

Figure 1:
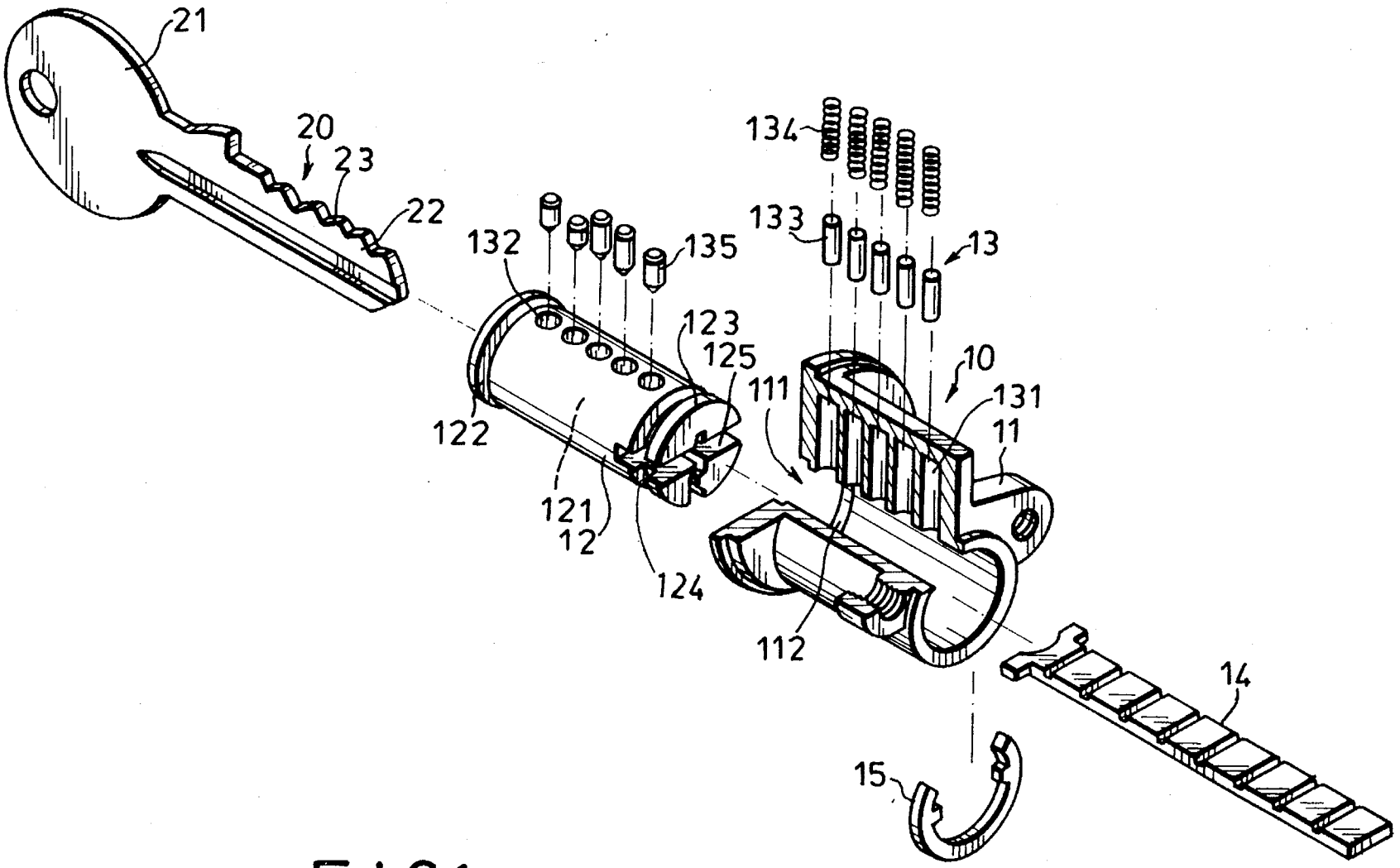
FIG.1 PRIOR ART
FIG. 1 is a partially sectional exploded view showing a conventional lock assembly.
Figure 2:
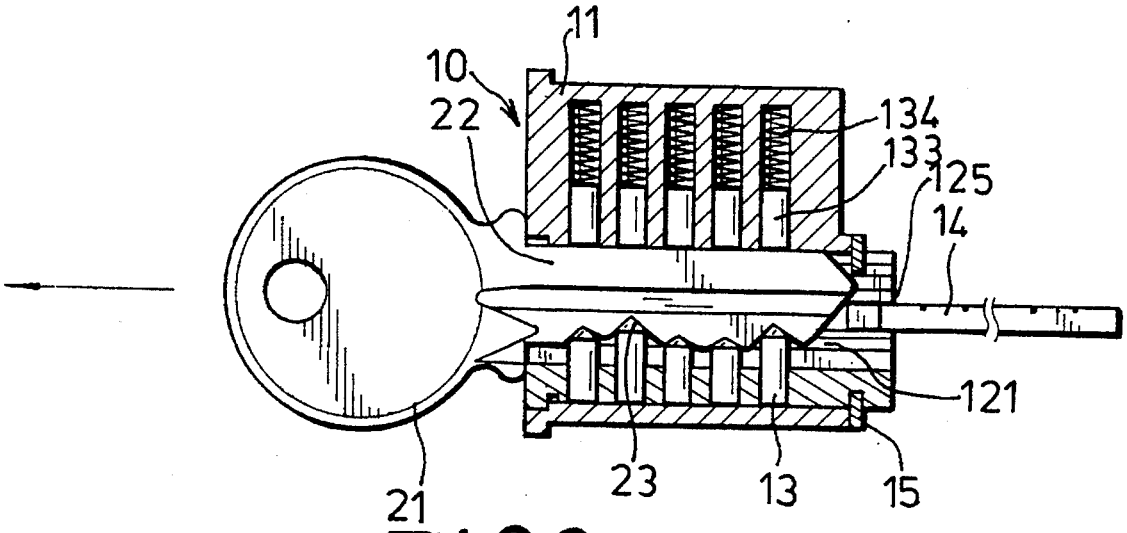
FIG.2 PRIOR ART
FIG. 2 is a schematic view illustrating how to operate the tumbler means of the conventional lock assembly.
Figure 4:
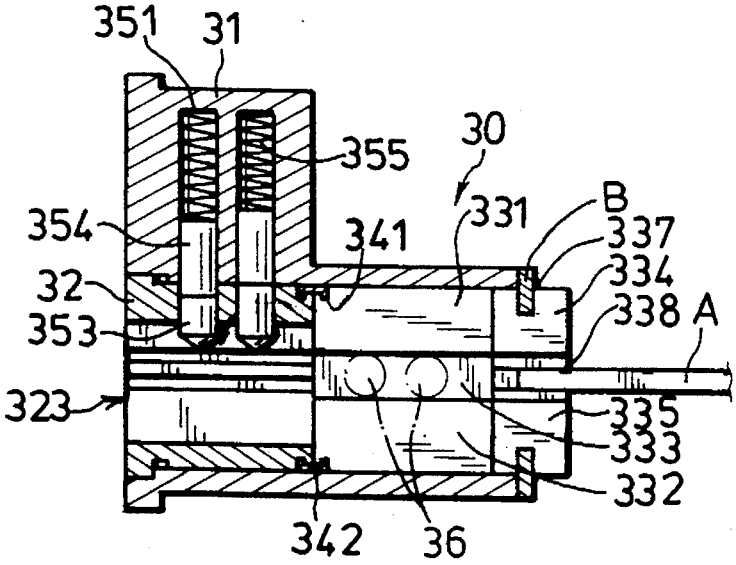
FIG. 4 is a sectional view showing the lock assembly of the first preferred embodiment of this invention.

The second key plug 33 further includes two retaining protrusions 334, 335 which project respectively from the rear end surfaces of the third and fourth plug halves 331, 332 so as to define a retaining space 338, as shown in FIG. 4, between the inner surfaces of the retaining protrusions 334, 335 for receiving a tailpiece (A) which is used to unlock the lock assembly 30 in a known manner when the tailpiece (A) is rotated synchronously with the second key plug 33. Referring again to FIG. 3, each of retaining protrusions 334, 335 has an annular locking groove 337 which is formed in the curved outer surface thereof. The annular locking grooves 337 are aligned with each other. A C-shaped lock element (B) is sleeved securely on the annular locking grooves 337 of the retaining protrusions 334, 335, as shown in FIG. 4, so as to lock the second key plug 33 on the lock shell 31.

Referring again to FIG. 3, the first tumbler means includes two first outer tumbler holes 351 formed in the lock shell 31 and communicated with the accommodation hole 313, and two first inner tumbler holes 352 formed radially in the first key plug 32 to communicate with the first key way 323 and aligned respectively with the first outer tumbler holes 351 when the lock assembly 30 is at the locked position, and two first tumbler pin units 35 mounted resiliently in the first outer and inner tumbler holes 351, 352. Each of the first tumbler pin units 35 includes a first outer tumbler pin 354 received in a respective one of the first outer tumbler holes 351, and a first inner tumbler pin 353 received in a respective one of the first inner tumbler holes 352. Referring again to FIG. 4, each of the first inner tumbler pins 353 is in contact with a respective one of the first outer tumbler pins 354 and is biased toward the first key way 323 by means of a respective first tumbler spring 355 which is disposed within the first outer tumbler hole 351. Thus, the first outer tumbler pins 354 are disposed between the junction of the first key plug 32 and the lock shell 31. In this way, rotation of the first key plug 32 relative to the lock shell 31 is therefore prevented by means of the first outer tumbler pins 354, thereby locking the lock assembly 30.

The second tumbler means, as shown in FIG. 3, includes two second outer tumbler holes 361 formed in the lock shell 31 and spaced angularly from the first outer tumbler holes 351 by an angle of 90 degrees, two second inner tumbler holes 362 formed radially in the second key plug 33 to communicate with the second key way 333 and aligned respectively with the second outer tumbler holes 361 when the lock assembly 30 is at the locked position, and two second tumbler pin units 36 mounted resiliently in the second outer and inner tumbler holes 361, 362. Each of the second tumbler pin units 36 is similar in construction to the first tumbler pin units 35 of the first tumbler means and includes a second inner tumbler pin 363, a second outer tumbler pin 364, and a second tumbler spring 365 which can prevent rotation of the second key plug 33 relative to the lock shell 31 in the same manner as that of the first tumbler means when the lock assembly 30 is at the locked position.

Figure 5:
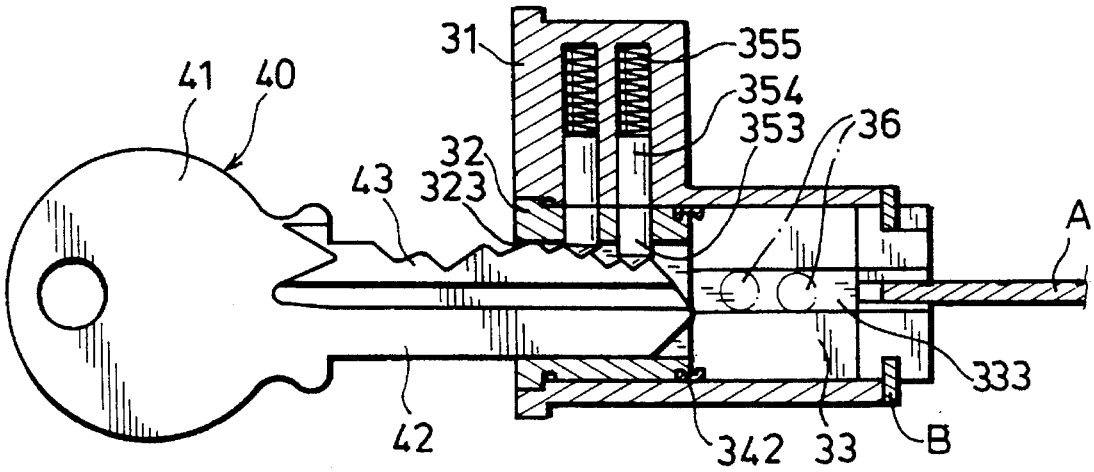
FIG. 5 is a schematic view illustrating the first step of operating the lock assembly in accordance with the first preferred embodiment of this invention.
Figure 6:
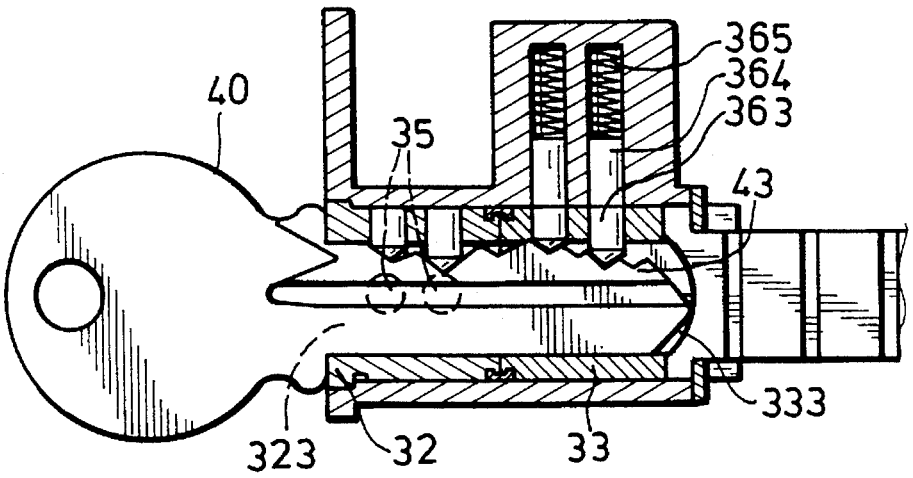
FIG. 6 is a schematic view illustrating the second step of operating the lock assembly in accordance with of the first preferred embodiment of this invention so as to unlock the lock assembly.

The key 40 includes a handle 41 formed integrally with a key body 42. The key body 42 has a plurality of actuating protrusions 43 of different shapes for operating the first and second tumbler pin units 35, 36 when the key body 42 is inserted successively into the first and second key ways 323,333. When the key body 42 of the key 40 is inserted into the first key way 323 of the first key plug 32, the actuating protrusions 43 of the key body 42 can operate the first inner tumbler pins 353 of the first tumbler means, thereby engaging the key body 42 with first key plug 32 and disengaging the first key plug 32 from the lock shell 31 so as to permit rotation of the first key plug 32 relative to the lock shell 31, as shown in FIG. 5. Thus, the first key way 323 of the first key plug 32 is aligned with the second key way 333 of the second key plug 33, thereby permitting further insertion of the key body 42 of the key 40 into the second key way 333 of the second key plug 33, as shown in FIG. 6. At this time, the actuating protrusions 43 of the key body 42 can operate the second inner tumbler pins 363 of the second tumbler means so as to rotate the second key plug 33 synchronously with the first key plug 32 relative to the lock shell 31, thereby rotating the tailpiece (A) to unlock the lock assembly 30. Owing to the presence of two key plugs 32, 33, it is difficult for a person who has an ordinary skill in the art to unlock the lock assembly 30 by means of a simple tool in a very short time. The pickproof characteristics of the lock assembly 30 is therefore enhanced.

Of course, the lock assembly of this invention can have more than two key plugs to be mounted within the lock shell in the same manner as that of the first preferred embodiment so as to increase the difficulty of unlocking the lock assembly by means of a simple tool, thereby further enhancing the pickproof characteristics of the lock assembly.

Figure 7:
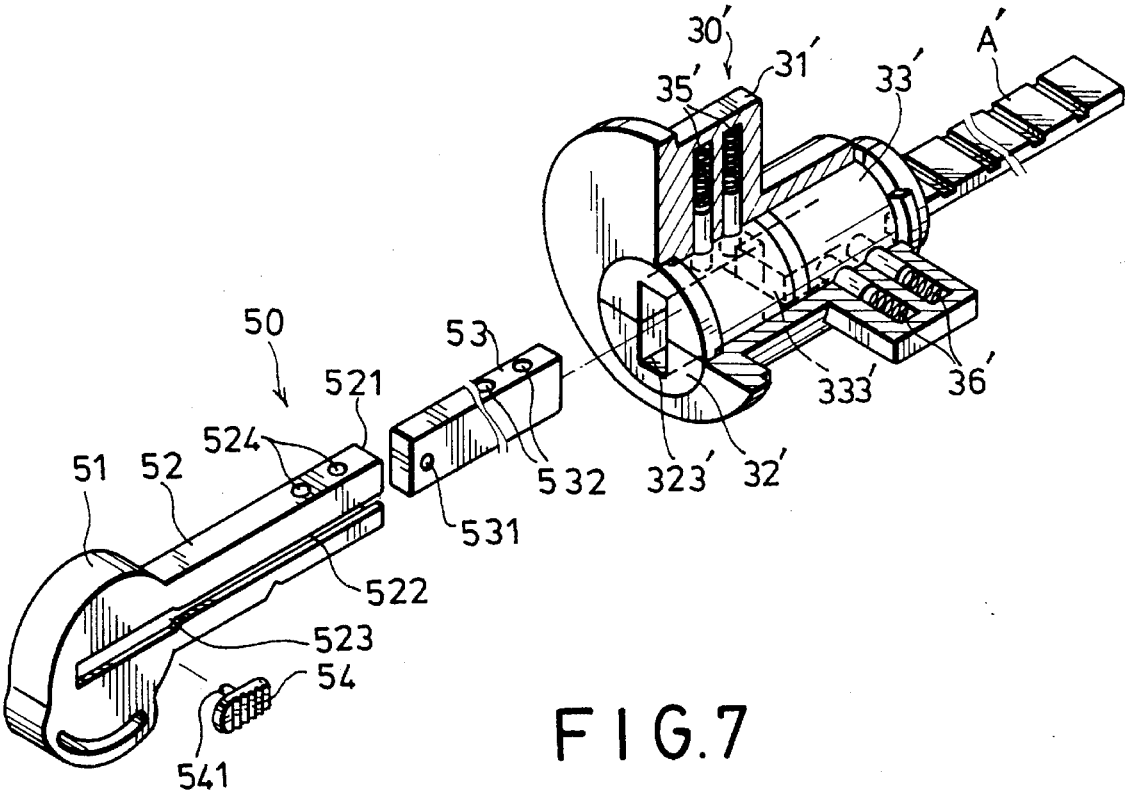
FIG. 7 shows a lock assembly of the second preferred embodiment of this invention.

FIG. 7 shows a lock assembly 30' of the second preferred embodiment of this invention. The lock assembly 30' includes a lock shell 31', a coupling means (not shown), first and second key plugs 32', 33', first and second tumbler means, and a key 50

The lock shell 31', the first and second key plugs 32', 33', the coupling means, and the first and second tumbler means are similar in construction to those of the lock assembly 30 of first preferred embodiment of this invention except for the first key way 323' of the first key plug 32' and the second key way 333' of the second key plug 33'. The first key way 323' of the first key plug 32' has a cross section which has a size slightly larger than that of the cross section of the second key way 333' of the second key plug 33'.

Figure 8:
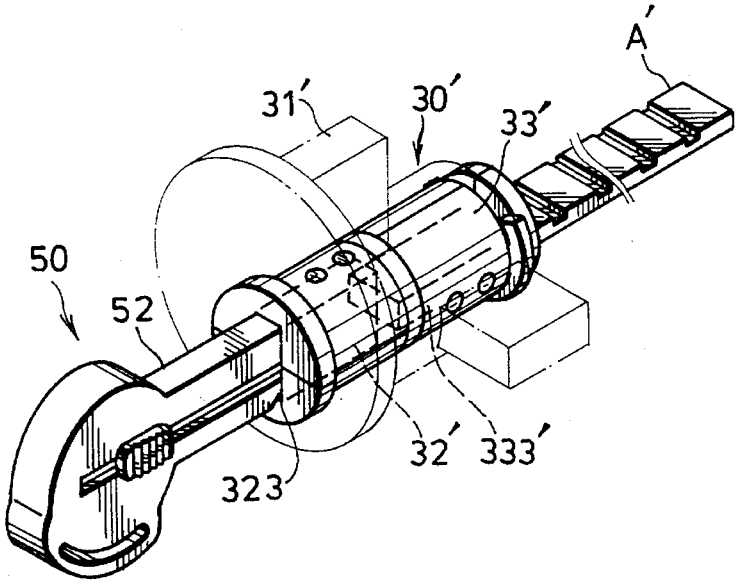
FIG. 8 is a schematic view illustrating the first step of operating the lock assembly in accordance with the second preferred embodiment of this invention.
Figure 9:
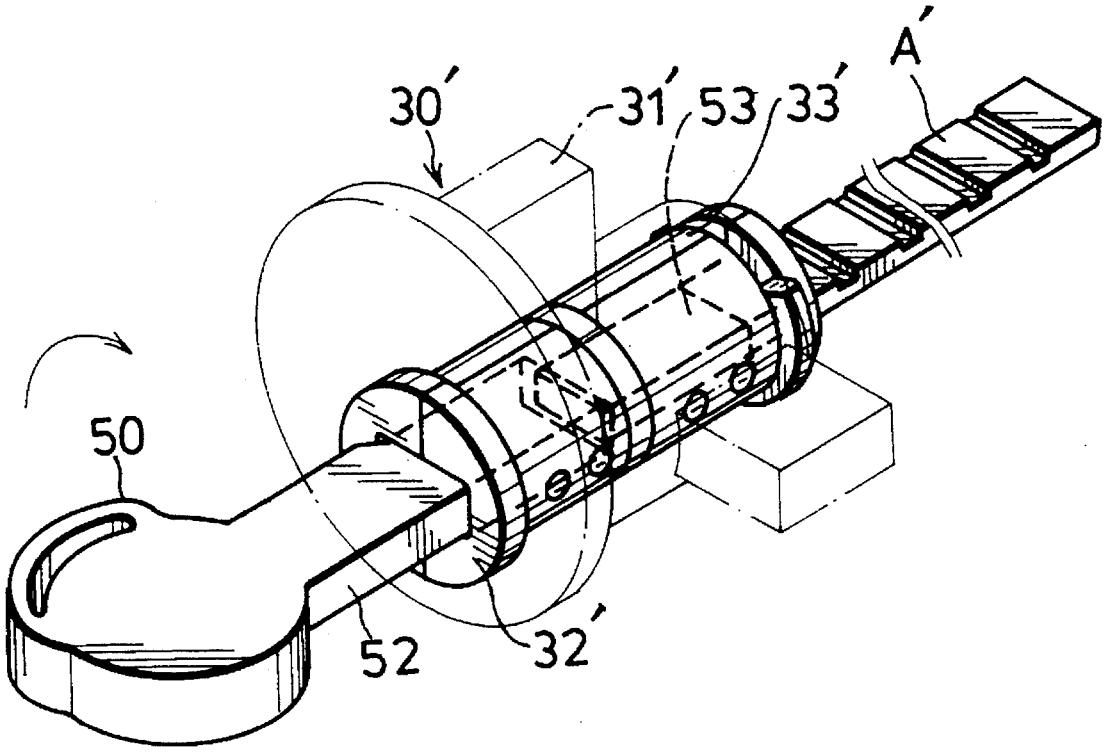
FIG. 9 is a schematic view illustrating the second step of operating the lock assembly in accordance with the second preferred embodiment of this invention so as to unlock the lock assembly.

The key 50 includes a handle 51 formed integrally with a hollow first key part 52. The first key part 52 has an opening 521 formed in a rear end thereof and communicated with an interior of the first key part 52, a longitudinally extending opening 522 which extends from the rear end of first key part 52 to the handle 51 and which is communicated with the interior of the first key part 52, and two first pits 524 for operating two first tumbler pin units 35' of the first tumbler means when the first key part 52 is inserted into the first key way 323' of the first key plug 32', as shown in FIG. 8, so as to rotate the first key plug 32' relative to the lock shell 31', thereby aligning the first key way 323' of the first key plug 32' with the second key way 333' of the second key plug 33', as shown in FIG. 9

Referring again to FIG. 7, the key 50 further includes a second key part 53 which is mounted telescopically within the interior of the first key part 52. The second key part 53 has a predetermined length and can be extended into the second key way 333' of the second key plug 33' from the opening 521 of the first key part 52 when the first key way 323' is aligned with the second key way 333'. The second key part 53 further has two second pits 532 for operating the second tumbler pin units 36' of the second tumbler means so as to rotate the second key plug 33' relative to the lock shell 31', thereby rotating a tailpiece (A') to unlock the lock assembly 30' in a known manner. An operating means includes an operating button 54 with a bar 541 which extends through the longitudinally extending opening 522 to engage a hole 531 of the second key part 53 so as to fix the operating button 54 on the second key part 53. The operating button 54 is operable to slide the second key part 53 relative to the first key part 52 along the longitudinally extending opening 522. Thee longitudinally extending opening 522 has a section at the handle 51 higher than another section at the key body 52 so as to define upper and lower shoulders 523 which can stop further movement of the operating button 54 toward the second key plug 33' in order to confine the movement of the operating button 54 within the handle 51, thereby facilitating the operation of the operating button 54 by the user.

With this invention thus explained, it is apparent that numerous modifications and variations can be made without departing from the scope and spirit of this invention. It is therefore intended that this invention be limited only as indicated in the appended claims.

I claim:

1. A lock assembly, comprising:

a lock shell having a front end, a rear end, and an accommodation hole extending from said front end to said rear end;

at least first and second key plugs aligned axially and mounted rotatably within said accommodation hole of said lock shell, said first and second key plugs respectively having first and second key ways;

at least first and second tumbler means for positioning respectively said first and second key plugs against said lock shell when said lock assembly is in a locked position; and a key to operate said first and second tumbler means so as to rotate said first and second key plugs simultaneously;

said first and second key ways being aligned for extension of said key from said first key way to said second key way when said first key plug is turned a predetermined angle relative to said second key plug by operating said first tumbler means, said second key plug being rotatable after said first and second key ways are aligned with each other.

2. A lock assembly as claimed in claim 1, wherein said first tumbler means includes:

first outer tumbler holes formed in said lock shell;

first inner tumbler holes formed radially in said first key plug to communicate with said first key way and aligned respectively with said first outer tumbler holes when said lock assembly is in said locked position; and first tumbler pin units received in said first outer and inner tumbler holes and biased toward said first key way when said lock assembly is in said locked position; and wherein said second tumbler means includes:

second outer tumbler holes formed in said lock shell and spaced angularly from said first outer tumbler holes by an angle of 90 degrees;

second inner tumbler holes formed radially in said second key plug to communicate with said second key way, and aligned respectively with said second outer tumbler holes when said lock assembly is in said locked position; and second tumbler pin units received in said second outer and inner tumbler holes and biased toward said second key way when said lock assembly is in said locked position.

3. A lock assembly as claimed in claim 1, wherein said first key plug has a rear end adjacent to a front end of said second key plug, said lock assembly further comprising a coupling means for interconnecting rotatably said adjacent rear and front ends of said first key plug and said second key plug.

4. A lock assembly as claimed in claim 3, wherein said first key plug includes a first annular groove formed in said rear end thereof, said second key plug having a second annular groove formed in said front end thereof, said coupling means having a pair of opposite retaining elements of substantially semi-circular shape provided around said adjacent rear and front ends of said first and second key plugs, each of said retaining elements having two circumferential flanges extending radially into said first and second annular grooves respectively and being slidable therealong, said coupling means further having two connecting elements respectively interconnecting adjacent distal ends of said retaining elements so as to retain said retaining elements within said first and second annular grooves of said first and second key plugs.

5. A lock assembly as claimed in claim 2, wherein said key includes a handle formed integrally with a hollow first key part for operating said first tumbler means, a second key part inserted telescopically in said first key part for operating said second tumbler means, and means for operating said second key part to extend out of said first key part.

6. A lock assembly as claimed in claim 5, wherein said first and second key parts include pits for operating said first and second tumbler means.

7. A lock assembly as claimed in claim 6, wherein said first key part further has a longitudinally extending opening which extends to said handle and which is communicated with an interior of said first key part, said operating means having an operating button which is mounted to said second key part and which extends outwardly of said first key part through said longitudinally extending opening, said operating button being operable to slide said second key part relative to said first key part.

* * * * *